US005345921A

United States Patent [19]

Iwano et al.

[11] Patent Number: 5,345,921

[45] Date of Patent: Sep. 13, 1994

[54] ENGINE AIR-FUEL RATIO CONTROLLER

[75] Inventors: Hiroshi Iwano, Yokosuka; Hatsuo Nagaishi, Yokohama, both of Japan

[73] Assignee: Nissan Motor Co., Ltd., Japan

[21] Appl. No.: 128,964

[22] Filed: Sep. 30, 1993

[30] Foreign Application Priority Data

Oct. 2, 1992 [JP] Japan ..... 4-265064

[51] Int. Cl.[5] ..... F02D 41/14

[52] U.S. Cl. ..... 123/686

[58] Field of Search ..... 123/682, 683, 685, 686, 123/689, 491

[56] References Cited

U.S. PATENT DOCUMENTS

| | | | |
|---|---|---|---|
| 4,221,194 | 9/1980 | Wright | 123/686 X |
| 4,475,517 | 10/1984 | Kobayashi et al. | 123/686 X |
| 4,492,204 | 1/1985 | Bertsch et al. | 123/685 |
| 4,586,478 | 5/1986 | Nogami et al. | 123/686 X |
| 4,777,924 | 10/1988 | Fujimura et al. | 123/685 X |
| 5,279,275 | 1/1994 | Freudenberg | 123/686 X |

FOREIGN PATENT DOCUMENTS

| | | |
|---|---|---|
| 60-209646 | 10/1985 | Japan . |
| 61-241434 | 10/1986 | Japan . |

*Primary Examiner*—Willis R. Wolfe

*Attorney, Agent, or Firm*—Lowe, Price, LeBlanc & Becker

[57] ABSTRACT

A fuel supply amount is feedback controlled by a controller according to a feedback correction amount computed based on the output of an oxygen sensor installed in an exhaust pipe. An air-fuel ratio detected by this sensor is used to update a basic injection feedback correction amount which is a step fraction when there is a change-over of the air-fuel ratio, and an integral fraction when there is no change-over of the air-fuel ratio. This controller is further provided with a mechanism for detecting engine start-up, a mechanism for setting an initial value of a warm-up correction amount according to the engine temperature during start-up, a mechanism for computing a warm-up correction amount reduced according to the time elapsed after start-up, and a mechanism for adding this warm-up correction amount to said step fraction. The amplitude of the air-fuel ratio variation during engine warm-up is therefore maintained at or above a certain level, and the exhaust conversion efficiency of the three-way catalyst during the warm-up is improved.

5 Claims, 9 Drawing Sheets

ENGINE AIR-FUEL RATIO CONTROLLER

FIELD OF THE INVENTION

This invention relates to a device which performs feedback control of the air-fuel ratio of the gas mixture supplied to an engine according to the oxygen concentration of the exhaust gas.

BACKGROUND OF THE INVENTION

It is known that, in an engine using a three-way catalytic converter for purifying CO, HC and NOx, a high purifying efficiency is obtained If the AFR of the gas mixture supplied to the combustion chamber of the engine is periodically made to vary within a narrow range (referred to as a catalyst window) centered on a theoretical AFR.

This is generally accomplished by a feedback control of the gas mixture. e.g. an injection amount of a fuel injection valve is controlled according to the output of an oxygen sensor ($O_2$ sensor) installed in the exhaust pipe, and an AFR feedback correction coefficient $\alpha$ is updated according to tile variation of the AFR about a theoretical AFR.

The output of the $O_2$ sensor varies sharply when the AFR of the gas mixture supplied to the engine crosses the theoretical AFR from rich to lean or vice versa. Hence, it is possible to detect this AFR variation around the theoretical AFR, and to determine whether the present AFR is rich or lean.

The updating amount of the AFR feedback correction coefficient $\alpha$ comprises a step fraction and an integral fraction, the step fraction being added to $\alpha$ when the AFR variation includes the theoretical AFR, and Integral fractions smaller than the step fraction being added when the AFR remains either rich or lean until it again crosses the theoretical AFR. The AFR therefore varies stably and periodically within a predetermined narrow range about tile theoretical AFR as center.

This kind of AFR feedback control is conventionally performed when the engine and catalyst in the catalytic converter are fully warmed up. In Japanese Tokkai Sho 61-241434 and Tokkai Sho 60-209646 published by the Japanese Patent Office, however, such a device is disclosed wherein the feedback control is begun immediately after start-up, i.e. when the engine is still cold.

If the temperature of the engine cooling water is low immediately after start-up, a wall flow is easily set up wherein part of the fuel supplied to the engine flows along the walls of the intake port without being converted to spray. This wall flow leads to a fuel supply response delay so that the AFR tends to lean. To deal with this, this device sets the target AFR more on the rich side than the theoretical AFR when the water temperature is low, and the AFR is controlled in a range centered on this target AFR. The effective operating range of the three-way catalyst is thereby enlarged, and the overall exhaust performance of the engine is improved.

However, this fuel injection response delay leads not only to a shift of AFR. If control is performed using a feedback correction coefficient $\alpha$ set when the engine is hot, the amplitude of the AFR variation In the catalyst window is less than when the engine is hot, and the conversion efficiency of the three-way catalyst consequently deteriorates by a corresponding amount.

Further, the output of the $O_2$ sensor installed in the exhaust pipe is affected by the temperature of the exhaust system, and at low temperature, the change-over of the sensor output to lean tends to be more sluggish than its change-over to rich. As a result, if the temperature of the exhaust system is low and the same feedback control is performed as in the hot state, the AFR is shifted to lean, and the optimum exhaust conversion efficiency of the three-way catalyst is not obtained.

SUMMARY OF THE INVENTION

It is therefore an object of this invention to prevent reduction of the amplitude of AFR variation in AFR feedback control Immediately after engine start-up, and by maintaining a suitable amplitude, to increase the exhaust conversion efficiency of the three-way catalyst during warm-up.

It is a further object of this invention to correct any bias of the output of the $O_2$ sensor immediately after engine start-up, and thereby to perform suitable AFR feedback control during warm-up.

In order to achieve the above object, this invention provides an air-fuel ratio controller for an engine having a combustion chamber, an intake pipe providing air to the combustion chamber, a mechanism for supplying fuel to the combustion chamber an exhaust pipe expelling a burnt gas in the combustion chamber, a mechanism for measuring a volume of the air provided by the intake pipe, a mechanism for setting a fuel supply amount of the supplying mechanism in proportion with the measured air volume, a three-way catalytic converter provided in the exhaust pipe, an oxygen sensor detecting whether or not the ratio of the air and fuel in the combustion chamber is rich or lean with respect to a theoretical value, a mechanism for determining from the detection whether the air-fuel ratio has changed over to lean or rich, a mechanism for computing a correction amount based on the change-over state, the amount being a step fraction during the change-over and an integral fraction smaller than the step fraction at times other than during the change-over, and a mechanism for correcting the fuel supply amount by the correction amount. This controller further comprises a mechanism for detecting engine start-up, a mechanism for measuring the time elapsed from the engine start-up, a mechanism for detecting engine temperature during the engine start-up, a mechanism for setting a warm-up correction amount according to said engine temperature during the start-up, a mechanism for reducing said warm-up correction mount according to the time elapsed after start-up, and a mechanism for adding said reduced amount to said step fraction.

Preferably, the mechanism for detecting engine temperature during the start-up comprises a sensor for detecting engine cooling water temperature.

Also preferably the reduced warm-up correction amount for the air-fuel ratio changed over to lean is larger than that for the a-fuel ratio changed over to rich.

Also preferably, the reduced warm-up correction amount for the air-fuel ratio changed over to lean is larger than that for the air-fuel ratio changed over to rich. This relation is materialized by setting a warm-up correction amount larger when the air-fuel ratio changes over to lean than when it changes over to rich.

Also preferably, the controller further comprises a mechanism for determining whether or not the oxygen sensor is active, and a mechanism for starting the correction when it is determined that the oxygen sensor is active.

The details as well as other features and advantages of this invention are set forth in the remainder of the specification and are shown in the accompanying drawings.

DESCRIPTION OF THE PREFERRED EMBODIMENTS

Figure 1:
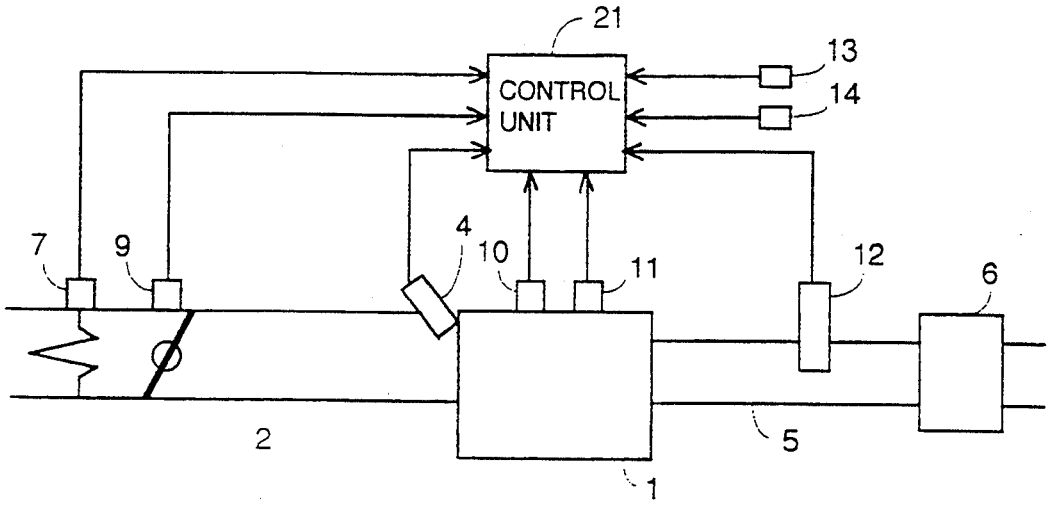
FIG. 1 is a schematic diagram of an air-fuel ratio controller according to this invention.

Referring to FIG. 1 of the drawings, a vehicle engine 1 is provided with an intake pipe 2 and an exhaust pipe 5, and an injector 4 in a part connecting the intake pipe 2 with the engine 1. The engine 1 is rotated by burning a mixture of air aspirated through the intake pipe 2 and fuel injected by the injector 4, and burnt gas is expelled from the exhaust pipe 5.

An air flow meter 7 for detecting an air intake amount Qa and an idle switch 9 detecting an idle position of a throttle are installed in the air intake pipe 2. An $O_2$sensor 12 whose output varies sharply about the theoretical AFR in response to the oxygen concentration of the exhaust gas, and a three-way catalytic converter 6 for purifying CO,HC and NOx in the exhaust gas, are installed in the exhaust pipe 5. A crank angle sensor 10 which outputs a signal every unit crank angle and a signal (Ref signal) for every reference position of the crank angle, and a water temperature sensor 11 for detecting the engine cooling water temperature, are installed in the engine 1.

The outputs from these sensors 7,9,10,11 and 12 are input to a control unit 21 consisting of a microcomputer.

Signals are also input to the control unit 21 from an ignition switch 13 and a vehicle speed sensor 14 for detecting vehicle speed.

The control unit 21 performs predetermined calculations based-on the input signals from these sensors, and controls a fuel injection mount of the injector 4. This injection amount is controlled by controlling the injection period, i.e. the injection pulse width.

The fuel concentration of the gas mixture, i.e. the AFR, is shifted to rich if the fuel injection mount is greater and shifted to lean if the fuel injection amount is less with respect to a fixed intake air volume.

Hence, if a basic injection pulse width is determined such that its ratio with respect to the intake air volume is constant, a gas mixture having a constant AFR is obtained even if the vehicle running conditions are different.

If one fuel injection is performed for each engine revolution, the basic injection pulse width Tp per revolution with respect to the air volume aspirated in one revolution, can be found from the relation $Tp=K*Qa/Ne$ (where K is a constant) using the intake air volume Qa and the engine revolution speed Ne. The AFR determined from this Tp is generally close to the theoretical AFR. However, the three-way catalytic converter 6 can only process the aforesaid three constituents of the exhaust gas, when the AFR of the gas mixture is within a narrow range having the theoretical AFR as center (the catalyst window). If the AFR is shifted outside this range by even a small amount toward rich, the amount of CO and HC in the exhaust gas increases, While if it is shifted toward lean, the amount of NOx in the exhaust gas increases. Further, a higher conversion efficiency is obtained if the AFR is allowed to periodically fluctuate within the catalyst window rather than fixing it at the theoretical AFR.

Figure 2:
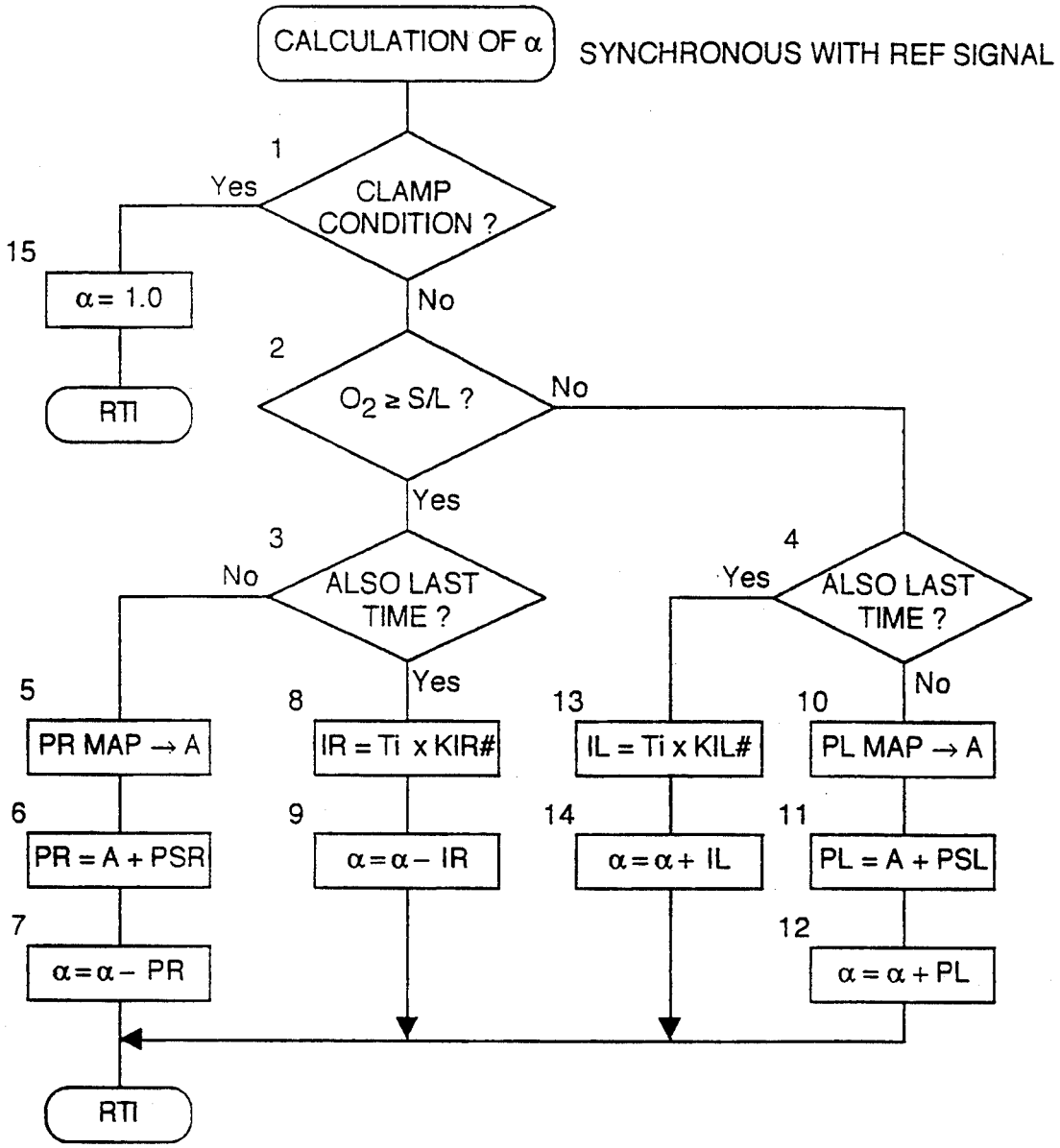
FIG. 2 is a flowchart showing an updating process of an AFR feedback correction coefficient $\alpha$ in the controller.

In order to maintain the AFR in this way, the control unit 21 performs feedback correction of the fuel injection mount from the injector 4 based on the output signal from the $O_2$ sensor 12. This correction process is shown in the flowchart of FIG. 2. Immediately after start-up, therefore, AFR feedback control begins after waiting for the $O_2$ sensor 12 to become active (step 1). In this case, the amplitude of the $O_2$ sensor output for example gradually increases with the temperature rise of the exhaust system, for example. It is determined that the $O_2$ sensor is active when its output fluctuates with an effectively constant amplitude about 500 mV as center, and AFR feedback control then begins. The amplitude of the $O_2$ sensor output further increases after the sensor has become active, then gradually falls to a constant level. The $O_2$ sensor 12 outputs a higher level signal than a slice level corresponding to the theoretical AFR when the AFR is rich, and outputs a lower level signal than the slice level when the AFR is lean, than the theoretical AFR. If the control unit 21 determines, based on this signal, that the AFR has changed from lean to rich, the step fraction PR is immediately subtracted from the AFR feedback correction coefficient $\alpha$.Subsequently. Integral fractions IR are subtracted from $\alpha$ until the AFR next changes back to lean (steps 2,3,7 and steps 2,3,9). Conversely, If it is determined that the AFR has changed from rich to lean, the step fraction PL is immediately added to $\alpha$.Subsequently, integral fractions IL are added to $\alpha$ until the AFR next changes back to rich (steps 2,4, and 14 and steps 2,4, 12).

The computation of $\alpha$ performed in synchronism with the Ref signal. This is because fuel injection is synchronized with the Ref signal, and scatter in the system is also synchronized with the Ref signal. The symbol "$O_2$" in the flowcharts indicates the output of the $O_2$ sensor 12, and "S/L" indicates the slice level.

The aforesaid step fractions PR, PL are much larger than the integral fractions IR, IL. By assigning a large step value immediately after the AFR has changed over, the AFR feedback correction coefficient $\alpha$ is made to vary rapidly so as to enhance control response, and by assigning small integral values thereafter, the variation of AFR is continued gradually so as to maintain control stability.

Figure 5:
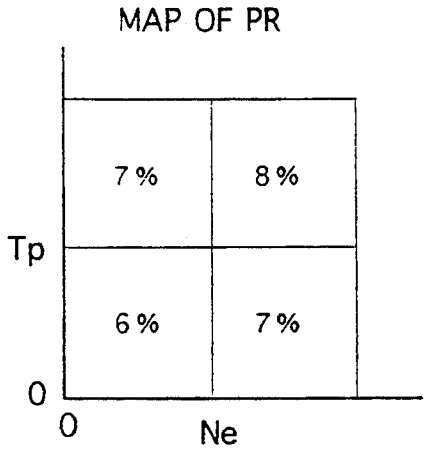
FIG. 5 is a map of a step fraction PR provided in the controller.
Figure 6:
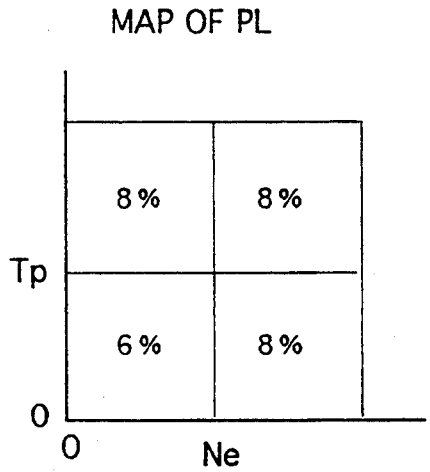
FIG. 6 is a map of a step fraction PL provided in the controller.

The step fractions PR, PL are looked up from maps shown in FIGS. 5 and 6 with the injection pulse width TP and engine revolution speed Ne as parameters (step 5, step 10).

By comparing FIGS. 5 and 6, it is seen that the map value of PL is larger than the map value of PR under certain running conditions.

Figures 7A, 7B, 7C:
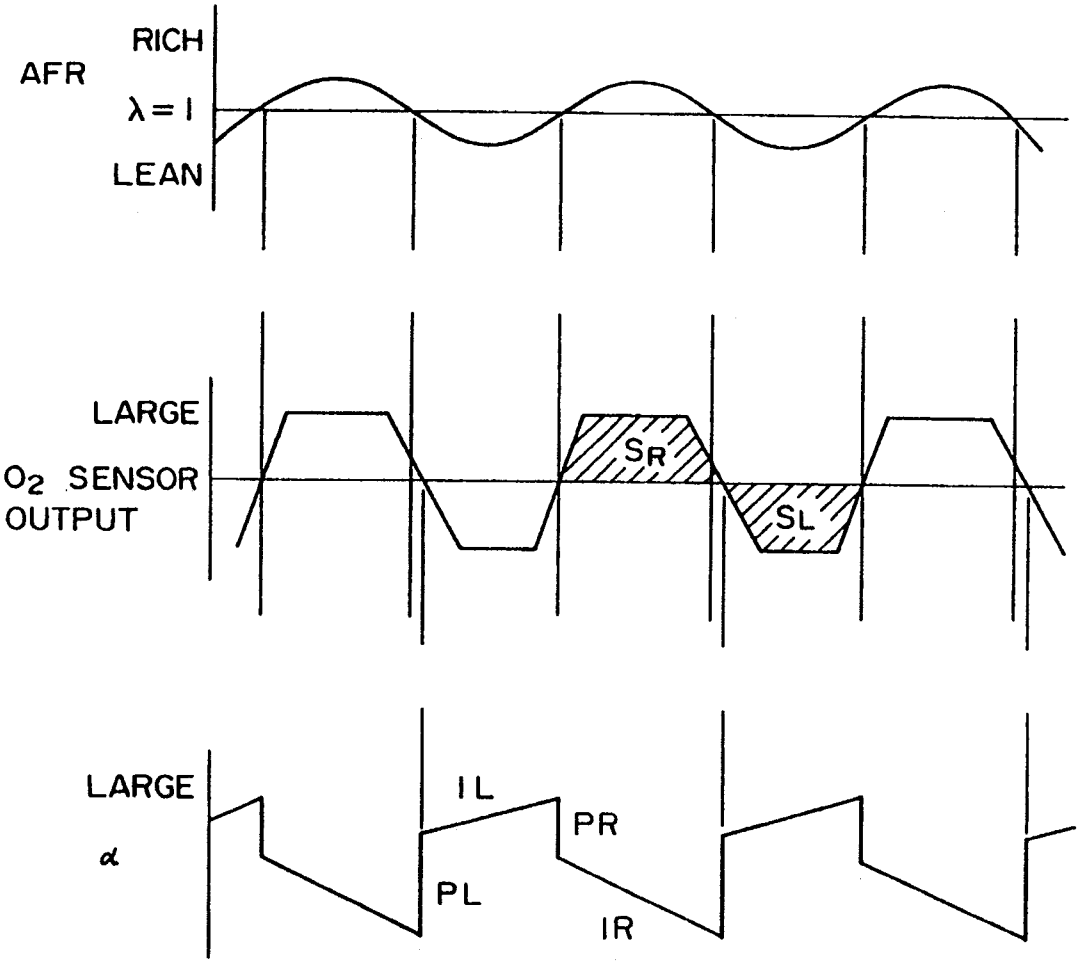
FIG. 7 is a graph showing general waveform variations of the AFR, $O_2$ sensor output and AFR feedback correction coefficient $\alpha$ under steady state conditions.

Under these running conditions, the output response of the $O_2$ sensor is different when the AFR changes over to rich from when it changes over to lean, the sensor output being delayed when it changes to lean as shown in FIG. 7.

If the magnitudes of the step values PL and PR are made the same, therefore, the average value of the AFR is shifted to lean from the theoretical AFR. Under certain running conditions, therefore, the map value of the step fraction PL added when there is a change-over to lean is arranged to be larger than the step fraction PR when there is a change-over to rich so as to compensate the response delay of the $O_2$ sensor output.

The integral fractions IR, IL are given in proportion to the fuel injection pulse width Ti, described hereinafter, by the following equations (steps 8,13).

IR=Ti*KIR# where, KIR# is a constant

IL=Ti*KIL# where, KIL# is a constant

If IR and IL are made constant values, the amplitude of $\alpha$ is too large under running conditions when $\alpha$ has a long control period so that the AFR may shift outside the catalyst window. Thus, by arranging IR and IL to be proportional to the injection pulse width Ti as described hereinabove, the amplitude of $\alpha$ is kept effectively constant and is not affected by the control period.

KIR# and KIL# can have the same values, but they may also be set to have different values. In the latter case, the average value of the AFR is shifted either to rich or lean due to the difference of integral fractions, so the settings of the aforesaid map values PR and PL must then be changed so that the average value of AFR is equal to the theoretical AFR.

Figure 3:
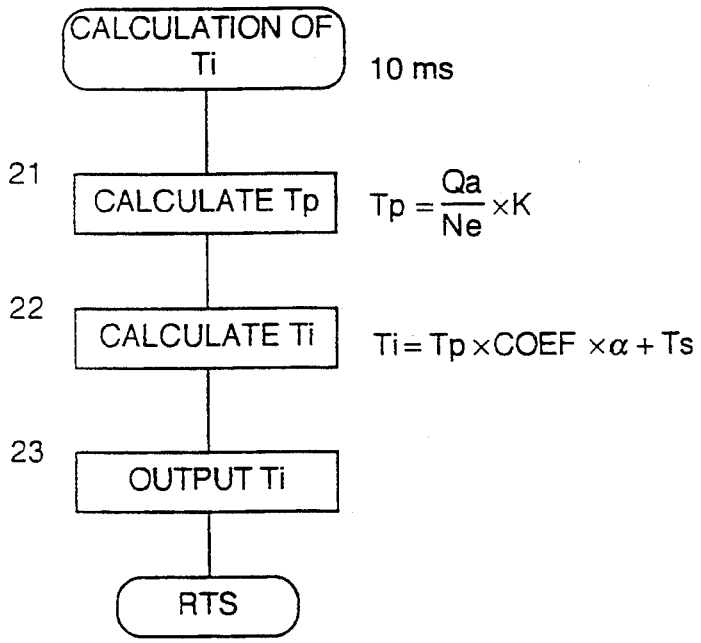
FIG. 3 is a flowchart showing a process by which an injection pulse width Ti is calculated in the controller.

Hence, if the gas mixture is leaner than the theoretical AFR, the control unit 21 increases the fuel injection amount supplied by the injector 4, conversely if the gas mixture is richer, the fuel injection amount from the injector 4 is decreased. The AFR is thus caused to vary within the catalyst window about the theoretical AFR. Until the $O_2$ sensor 12 becomes active, $\alpha$ is set equal to 1.0 and feedback control is not performed (step 15). FIG. 3 shows the routine for computing the fuel injection pulse width Ti. This routine is executed every 10 ms. The injection pulse width Ti is calculated by the following well-known equation:

$$Ti = Tp*COEF*\alpha + Ts$$

where,

Tp=basic injection pulse width

COEF=various correction coefficients $\alpha$=AFR feedback correction coefficient Ts=ineffectual pulse width After engine start-up, the $O_2$ sensor becomes active before the catalyst has completely warmed up, and the temperature of the exhaust system rises before the temperature of the cooling water rises. Starting AFR feedback control as soon as the $O_2$ sensor is active therefore means that AFR feedback control begins when the water temperature is still low.

If AFR feedback control is begun immediately after engine start-up, the response delay of the fuel in the intake port increases when the water temperature is low. Consequently, the step fraction which is correct when the exhaust system is hot is inadequate to make the AFR periodically vary within the catalyst window, and the value required of the step fraction changes as the exhaust system warms up. Further, the step fraction required during hot re-start is different from the amount required when the exhaust system is hot. Therefore, if the step fractions PR, PL which are correct when the engine is hot, are used from when AFR feedback control of the map values in Figs. 5 and 6 begins, the conversion efficiency of the three-way catalyst declines. In order to prevent this, after it has been determined that the $O_2$ sensor 12 is active, the control unit 21 adds a warm-up correction value computed as described hereinafter, to the step fractions PR, PL which are correct only for the case when the exhaust system is hot. More specifically, a warm-up correction amount PSR is added to the map value PR when there is a change-over to rich, and a warm-up correction mount PSL is added to the map value PL when there is a change-over to lean. In FIG. 2, the map values PR, PL are entered in an accumulator A, and the warm-up correction amount is added to the value of this accumulator A (steps 5,6 and steps 10,11).

The warm-up correction amounts PSR, PSL are set to initial values according to a value corresponding to the exhaust system temperature during start-up, and these initial values are gradually decreased with the time elapsed after start-up. As the value corresponding to the exhaust system temperature, the cooling water temperature Tw is used.

Figure 4:
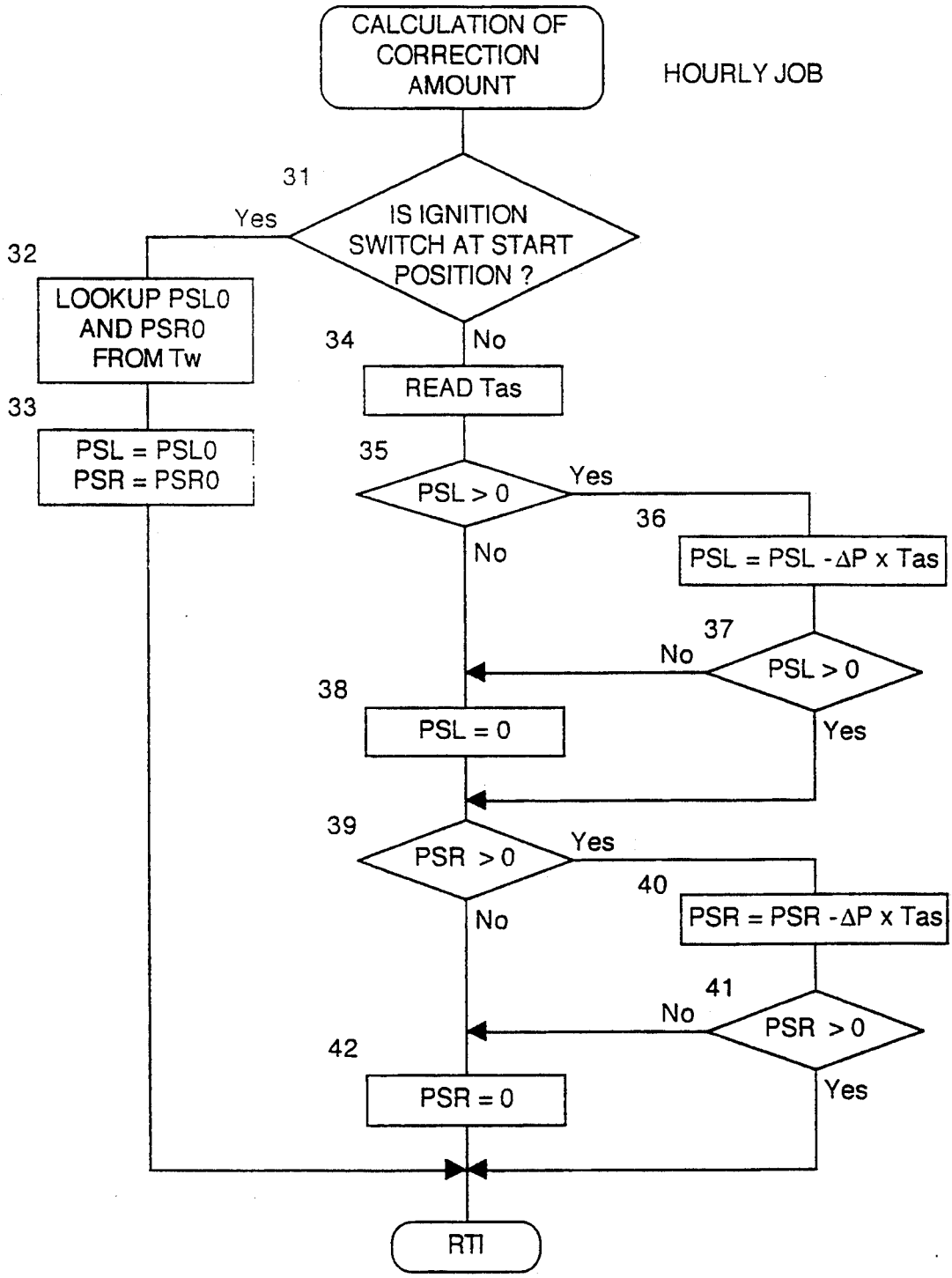
FIG. 4 is a flowchart showing a process by which short-term time correction amounts PSL and PSR are calculated in the controller.

FIG. 4 is a flowchart for computing the warm-up correction amount. In this flowchart, when the ignition switch is in the START position, a table of initial values of warm-up correction amounts is looked up from the cooling water temperature Tw. The initial value PSLO when there is a change-over to lean, and the initial value PSRO when there is a change-over to rich, are computed, and entered in corresponding PSL and PSR registers (steps 31–33). The values of PSL and PSR are the warm-up correction amounts.

Figure 8:
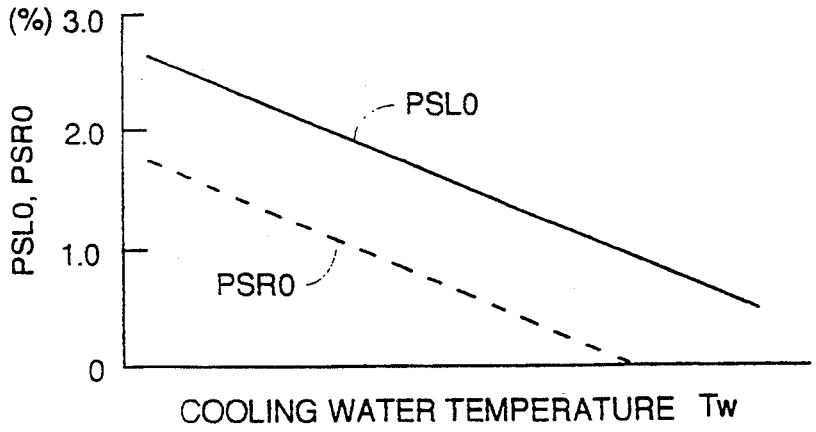
FIG. 8 is a graph showing initial values PSLO and PSRO of warm-up correction amounts used by the controller.

The values of PSLO and PSRO increase the lower the cooling water temperature Tw, as shown in FIG. 8. This is because the fuel supply delay is longer and the AFR variation amplitude is smaller the lower the cooling water temperature Tw, and it is necessary to prevent decrease of the AFR variation amplitude by increasing the step fraction for lower water temperatures. After start-up, the warm-up correction amounts PSL, PSR are updated by the following equation according to the time elapsed from start-up (steps 34,36 and steps 34,40):

$$PSL = PSL - \Delta P*Tas \quad (1)$$

$$PSR = PSR - \Delta P*Tas \quad (2)$$

where,

Tas=time elapsed from start-up $\Delta$P=gain (fixed value)

When the calculated values of PSL,PSR are equal to or less than 0, the warm-up correction amount is set to 0 (steps 37,38 and steps 41,42).

Figure 9:
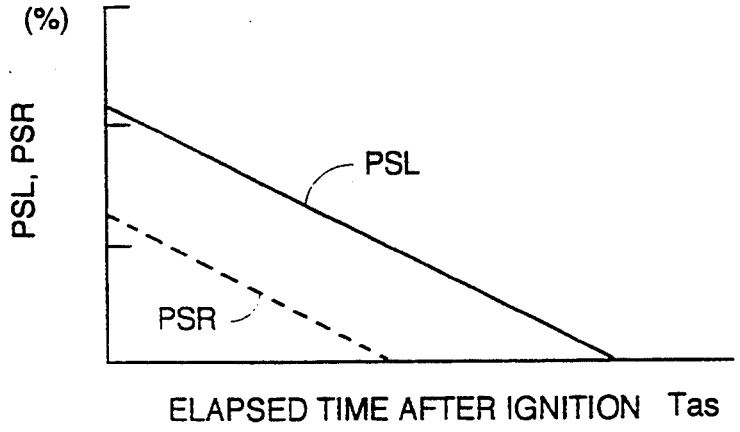
FIG. 9 is a graph showing the relations between the warm-up correction amounts PSL, PSR used by the controller and the time elapsed after engine start-up.

The warm-up correction amounts PSL, PSR are therefore reduced in steps of ΔP* Tas for each control period according to the time elapsed from start-up, as shown in FIG. 9. This is done in order to adjust to the warming-up of the exhaust system (catalytic converter). The required value of the warm-up correction mount therefore decreases according to the temperature rise of the exhaust system after start-up, and the correction finally becomes unnecessary when the exhaust system is hot.

A gain ΔP (%/sec) determines the reduction amount of the warm-up correction amount per control cycle. If this value is increased, the warm-up correction mounts PSL, PSR decrease rapidly, and if the value is decreased, the warm-up correction amounts PSL, PSR decrease slowly.

Figure 11:
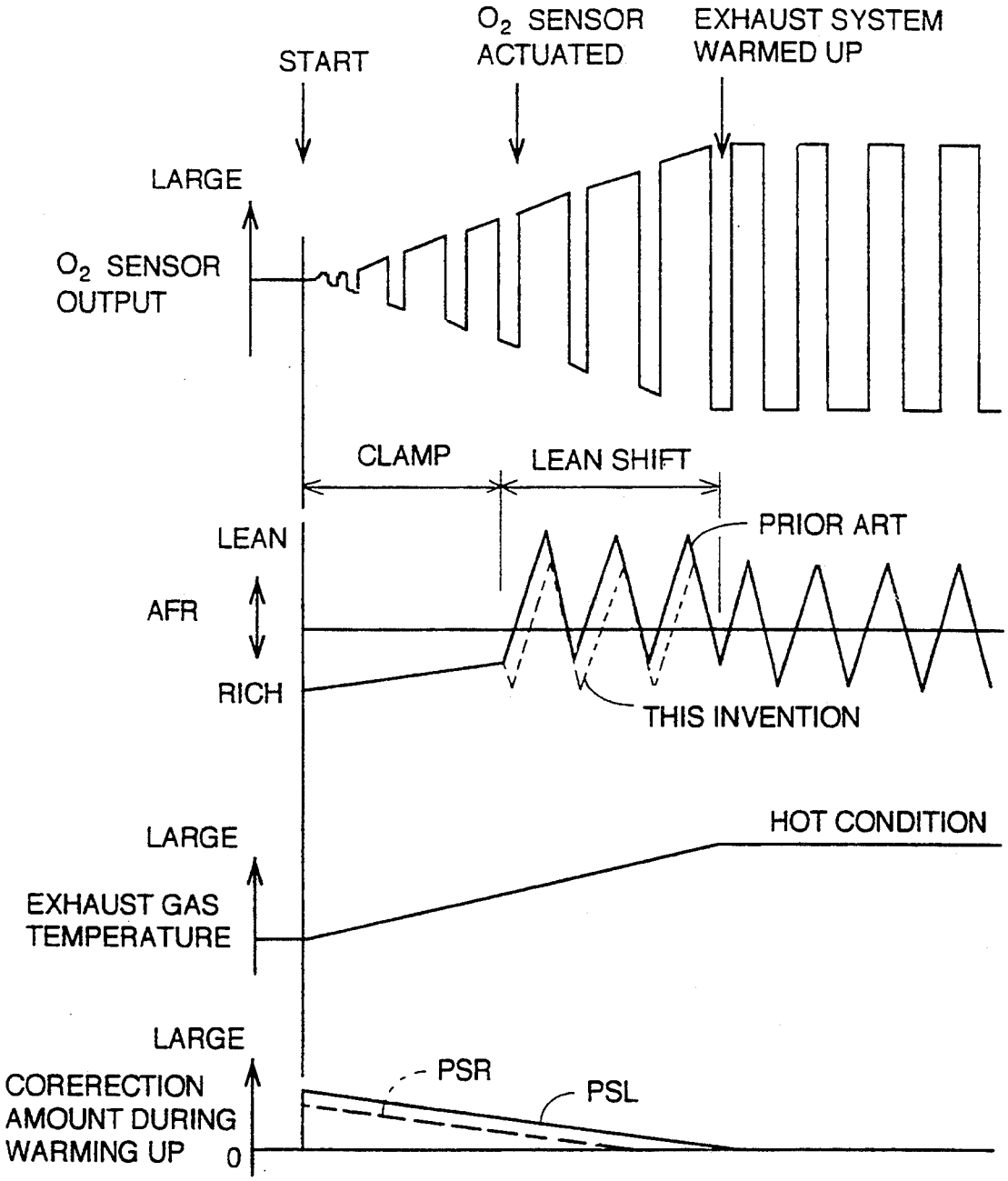
FIG. 11 is a graph describing control results according to this invention.

The gain ΔP is determined such that the warm-up correction mounts PSL, PSR are 0 when warm-up is completed. The temperature rise characteristics of the exhaust system are different depending on the engine and actual system used, and the value of the gain ΔP is set so that it correctly matches each individual system. As shown also in FIG. 11, feedback control begins when the $O_2$ sensor 12 becomes active. Thus, if the step fraction for low water temperature is increased by the warm-up correction amounts PSL, PSR, the amplitude of the AFR variation in the catalyst window increases accordingly, and deterioration of the conversion efficiency of the catalyst due to fuel supply delay is thereby prevented. Further, the exhaust system temperature rises with the time elapsed from start-up and gradually reaches the hot state. The warm-up correction amount is therefore progressively reduced with the temperature rise of the exhaust system, so that the correction depends on the warm-up state of the system and is neither excessive nor deficient. The exhaust performance immediately after start-up is therefore largely improved.

Further, as the cooling water temperature during hot re-start is high, the initial value of the warm-up correction amount is low. In this case, the supply of fuel in the port is not delayed, and it is sufficient to make a compensation only for the effect of the low temperature of the exhaust system. A small warm-up correction amount is therefore applied, over-correction is avoided and the conversion efficiency of the catalyst is improved.

However, in FIGS. 8 and 9, the warm-up correction amount PSL and its initial value PSLO when there is a change-over to lean are set larger than the warm-up correction amount PSR and its initial value PSRO when there is a change-over to rich. This is due to the following reason.

Figure 10:
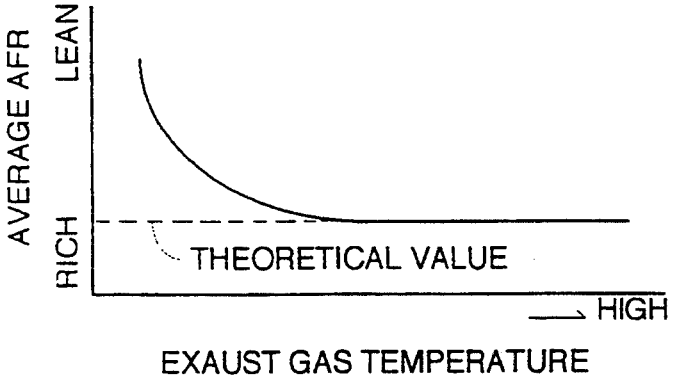
FIG. 10 is a graph describing a general temperature bias of the $O_2$ sensor outputs.

After the $O_2$ sensor 12 in this example has become active but warm-up is not yet complete, the output response of the sensor is delayed more when there is a change-over to lean than when there is a change-over to rich. Hence, if AFR feedback control is performed when warm-up correction amounts having the same values are assigned for a change-over to rich or to lean, i.e. PSR=PSL, the average value of the AFR is shifted to lean as shown by the solid line in FIG. 10, and the amount of NOx in the exhaust gas increases. The warm-up correction amount for a change-over to lean is therefore first assigned a large value so that the AFR returns to rich. In this way, the bias of the output of the $O_2$ sensor immediately after engine start-up is corrected, and suitable AFR feedback control can be performed.

If however an $O_2$ sensor is used having the same output when there is a change-over to rich or lean during warm-up, the warm-up correction amounts may be set such that PSR=PSL.

The foregoing description of the preferred embodiments for the purpose of illustrating this invention is not to be considered as limiting or restricting the invention, since many modifications may be made by those skilled in the art without departing from the scope of the invention.

The embodiments of this invention in which an exclusive property or privilege is claimed are defined as follows:

1. An air-fuel ratio controller for an engine having a combustion chamber, an intake pipe providing air to said combustion chamber, means for supplying fuel to said combustion chamber, an exhaust pipe expelling a burnt gas in said combustion chamber, means for measuring a volume of the air provided by said intake pipe, means for setting a fuel supply amount of said supplying means in proportion with said measured air volume, a three-way catalytic converter provided in said exhaust pipe, an oxygen sensor detecting whether or not the ratio of the air and fuel in said combustion chamber is rich or lean with respect to a theoretical value, means for determining from said detection whether said air-fuel ratio has changed over to lean or rich, means for computing a correction amount based on said change-over state, said amount being a step fraction during said change-over and an integral fraction smaller than said step fraction at times other than during said change-over, and means for correcting said fuel supply amount by said correction amount, said controller comprising:

means for detecting engine start-up, means for measuring the time elapsed from the engine start-up, means for detecting engine temperature during the engine start-up, means for setting a warm-up correction amount according to said engine temperature during the start-up, means for reducing said warm-up correction amount according to the time elapsed after start-up, and means for adding said reduced amount to said step fraction.

2. An air-fuel ratio controller as defined in claim 1, wherein said means for detecting engine temperature during the start-up comprises a sensor for detecting engine cooling water temperature.

3. An air-fuel ratio controller as defined in claim 1, wherein said reduced warm-up correction amount for the air-fuel ratio changed over to lean is larger than that for the air-fuel ratio changed over to rich.

4. An air-fuel ratio controller as defined in claim 3, wherein said means for setting a warm-up correction amount sets a larger warm-up correction amount when said air-fuel ratio changes over to lean than when it changes over to rich.

5. An air-fuel ratio controller as defined in claim 1, further comprising means for determining whether or not said oxygen sensor is active, and means for starting said correction when it is determined that said oxygen sensor is active.

* * * * *